US007527519B2

(12) United States Patent
Van Dyne

(10) Patent No.: US 7,527,519 B2
(45) Date of Patent: May 5, 2009

(54) ELECTRICAL RECEPTICAL

(76) Inventor: Kathleen Kyser Van Dyne, 431 SW. 35th St., Cape Coral, FL (US) 33914

( * ) Notice: Subject to any disclaimer, the term of this patent is extended or adjusted under 35 U.S.C. 154(b) by 0 days.

(21) Appl. No.: 11/973,427

(22) Filed: Oct. 9, 2007

(65) Prior Publication Data

US 2009/0090608 A1 Apr. 9, 2009

(51) Int. Cl.
*H01R 4/24* (2006.01)

(52) U.S. Cl. ..... 439/441

(58) Field of Classification Search ..... 439/441, 439/76.1, 638, 188; 200/1 R, 42.01; 361/627–632, 361/636, 641, 643; 307/40, 310.06, 126
See application file for complete search history.

(56) References Cited

U.S. PATENT DOCUMENTS 4,001,527 A 1/1977 Hulshizer
5,280,567 A 1/1994 Kobayashi
5,903,064 A * 5/1999 Norberg ..... 307/40
6,515,851 B1 * 2/2003 Ootori et al. ..... 361/679
6,674,025 B1 * 1/2004 Marchant ..... 200/1 R
2005/0094786 A1 5/2005 Ossa
2006/0209476 A1 9/2006 Bernstein

OTHER PUBLICATIONS

Unknown Author, Programmable Receptacle Timer, Unknown Date, www.smarthome.com/2046.html.

* cited by examiner

*Primary Examiner*—Jean F Duverne
(74) *Attorney, Agent, or Firm*—George F. Wallace

(57) ABSTRACT

An electrical receptacle includes a switch having an open state and a closed state; an electrical socket that receives an electrical plug; an electrical interface that directly couples to electrical wires and conductively carries current to the switch; a user interface having an input device that receives user commands, and an output device that sends user signals; and a timer that, upon user command, causes the switch to close. When the switch is in the closed state, current conductively reach the electrical socket. When in the open state, current does not conductively reach the electrical socket.

11 Claims, 4 Drawing Sheets

ELECTRICAL RECEPTICAL

FIELD OF THE INVENTION

The present invention relates to receptacles, and more specifically, to electrical receptacles.

BACKGROUND OF THE INVENTION

Electrical receptacles are used as interfaces between electrical sources and various electrical devices. One type of electrical receptacle is used to interface (or electrically connect) electrical wires within a wall or floor to electrical devices.

BRIEF SUMMARY OF THE INVENTION

It is, therefore, an object of the present invention to provide an electrical receptacle.

In an exemplary embodiment, the present invention can be embodied in an electrical receptacle that includes a current switch having an open state and a closed state; an electrical socket adapted to receive an electrical plug, the electrical socket being conductively connected to the current switch; an electrical interface adapted to directly couple to wires conductively carrying electrical current, and further adapted to conductively carry the electrical current to the current switch; and a user interface, communicatively connected to a timer, and having an input device adapted to receive an activation command from a user, and an output device adapted to send an activation signal to the user.

When the current switch is in the closed state, the electrical current conductively reaches the electrical socket, and when the current switch is in the open state, the electrical current does not conductively reach the electrical socket. The timer, upon receipt by the input device of the activation command, causes the current switch to close for a predetermined amount of time and causes the output device to send the activation signal.

The following, independently and/or in combination (two or more thereof), are additional exemplary embodiments and/or optional aspects of the present invention:

the receptacle can be attachable to, and connectively fit at least partially within, an electrical box disposed within one of a wall (e.g., a ceiling, etc.) and a floor;

the receptacle can include a faceplate having an interior face plate surface and an exterior face plate surface, the one of a wall and a floor can respectively include one of an exterior wall surface and an exterior floor surface, at least a portion of at least one of the input device and the output device can be accessible from the exterior faceplate surface, and when the receptacle is attached to the electrical box, the interior face plate surface opposes the one of an exterior wall surface and an exterior floor surface;

the receptacle can include a receptacle interface, the faceplate can be removably attachable to the receptacle, the faceplate can include a faceplate interface for at least one of electrical and communicative connection with the receptacle interface, and the at least a portion of at least one of the input device and the output device can be connected to the faceplate interface;

the faceplate can be integral with the receptacle;

the predetermined amount of time can be an indefinite amount of time;

the input device can be further adapted to receive a deactivation command from the user, the output device can be further adapted to send a deactivation signal to the user, and upon receipt by the input device of the deactivation command, the timer can cause the switch to open and the output device to send the deactivation signal;

the input device can include at least one button;

the output device can include a display device;

the display device can display a numeric value;

the input device can be further adapted to receive a start time and an end time from the user, the timer can include a clock having a set time, and based on the set time, the timer can cause the switch to close when the start time is reached and to open when the end time is reached.

BRIEF DESCRIPTION OF THE DRAWINGS

The present invention is illustrated by way of example, and not in limitation, in the figures of the accompanying drawings, in which.

DETAILED DESCRIPTION OF THE INVENTION

The invention will now be described in more detail by way of example with reference to the embodiments shown in the accompanying figures. It should be kept in mind that the following described embodiments are only presented by way of example and should not be construed as limiting the inventive concept to any particular physical configuration, shape, size, or order.

Figure 1:
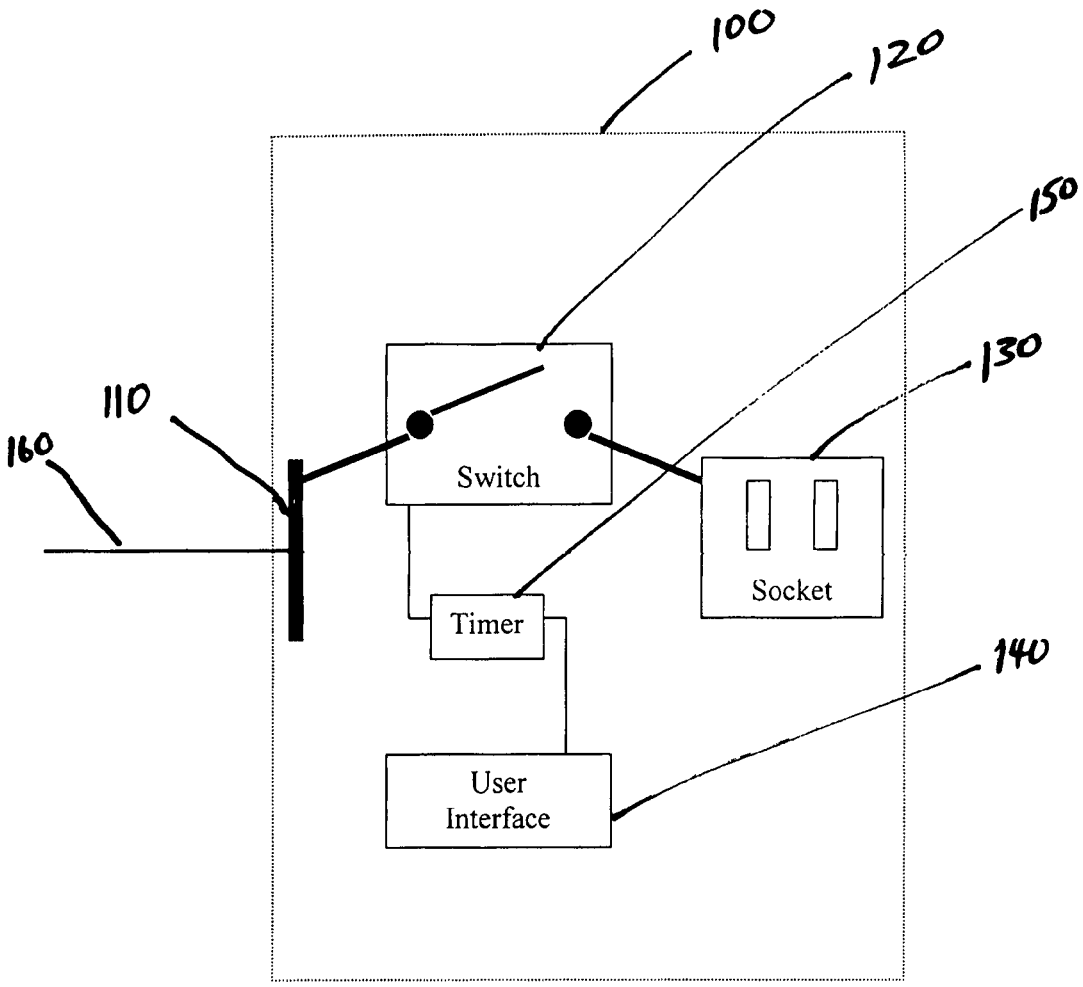
FIG. 1 illustrates exemplary aspects of an embodiment of the present invention.

FIG. 1 illustrates basic components of an exemplary embodiment of the present invention, in which an electrical receptacle 100 can include an electrical interface 110, a switch 120, at least one electrical socket 130, a user interface 140, and a timer 150.

Electrical interface 110 can be coupled to electrical wires 160 that carry electrical current. Coupling can be effectuated via any manner that conductively connects electrical interface 110 to electrical wires 160. For example, for direct connection with respective electrical wires 160, electrical interface 110 can include plural terminals having color-coded screws, such as, for example and not in limitation, one or more brass screws for black (or "hot") wire(s), one or more silver screws for white (or "neutral") wire(s), and a green screw for a ground wire. Additionally, electrical interface 110 is connected to switch 120, such that the electrical current is carried thereto.

Switch 120 is conductively connected to electrical socket 130, and thereby allows the electrical current from the electrical interface to flow to electrical socket 130 when switch 120 is in a closed state. When in an open state, however, switch 120 does not allow the electrical current to reach electrical socket 130. Optionally, switch 120 can have a default open state.

Electrical socket 130 is adapted to conductively engage with an electrical plug of a desired electrical device, such as a transformer, a light, a clothes iron, etc.

User interface 140 allows a user to functionally control timer 150. User interface 140 includes at least one input device for receiving an activation command, and at least one output device for sending an activation signal. An input device can be one or more buttons, for example and not in limitation; and an output device can be one or more display devices, such as an LCD or LED screen (with or without back-lighting), or an LED bulb (for example, to signal that one or more electrical sockets are "hot"); and/or an audible device, such as a speaker, for example.

Timer 150 triggers the closing and opening of switch 120. When switch 120 is closed, electrical current from electrical wires 160 conductively flows through switch 120 to electrical socket 130. Conversely, when switch 120 is open, the electrical current does not flow to electrical socket 130.

Figure 2:
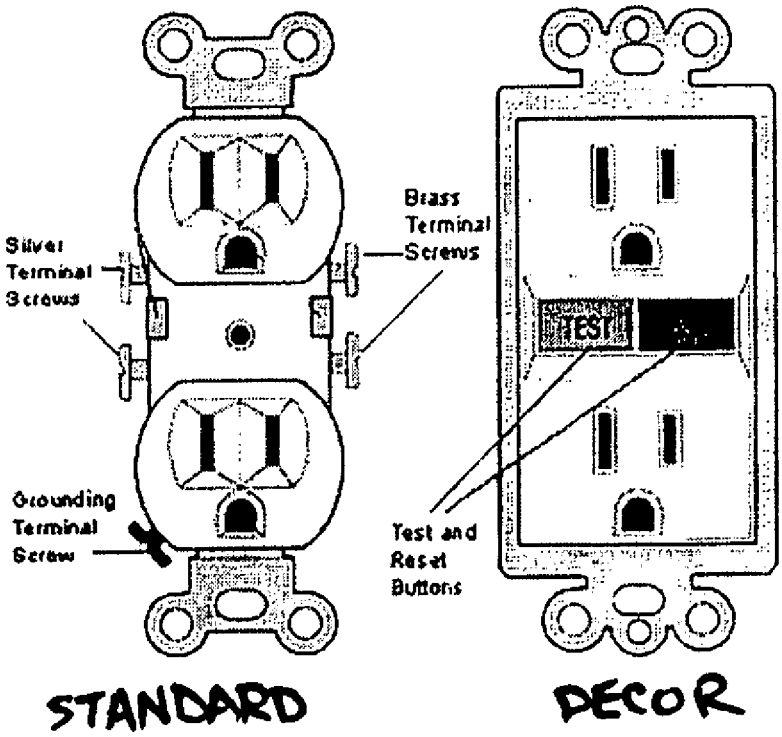
FIG. 2 shows exemplary configurations of conventional electrical receptacles.

As shown in FIG. 2, conventional electrical receptacles generally come in two shapes: standard and décor. While the electrical receptacle provided by the present invention can be similarly or identically shaped, it is not so limited. Therefore, the present invention can be provided in alternative shapes to the extent desired. For example, an exemplary embodiment of the present invention can provide a receptacle having the same height of a décor or standard receptacle, but having a portion thereof that is wider, so as to provide additional surface area for placement of one or more components of the user interface and/or timer, which may extent beyond the width of a conventionally sized receptacle. Likewise, another exemplary embodiment of the present invention can provide a receptacle having the same width of a décor or standard receptacle, but taller. Notably, the shape of a corresponding faceplate of the present invention can deviate, in a complementary manner, from that of a standard or décor variety faceplate to accommodate variations in height and/or width of a receptacle of the present invention. Further, a corresponding faceplate may include plural apertures or holes through which a user interface may be accessible, whether physically, visually, audibly, or otherwise. Further, the present invention can be embodied in a regular or GFI ("Ground Fault Interrupter") receptacle.

Figure 3:
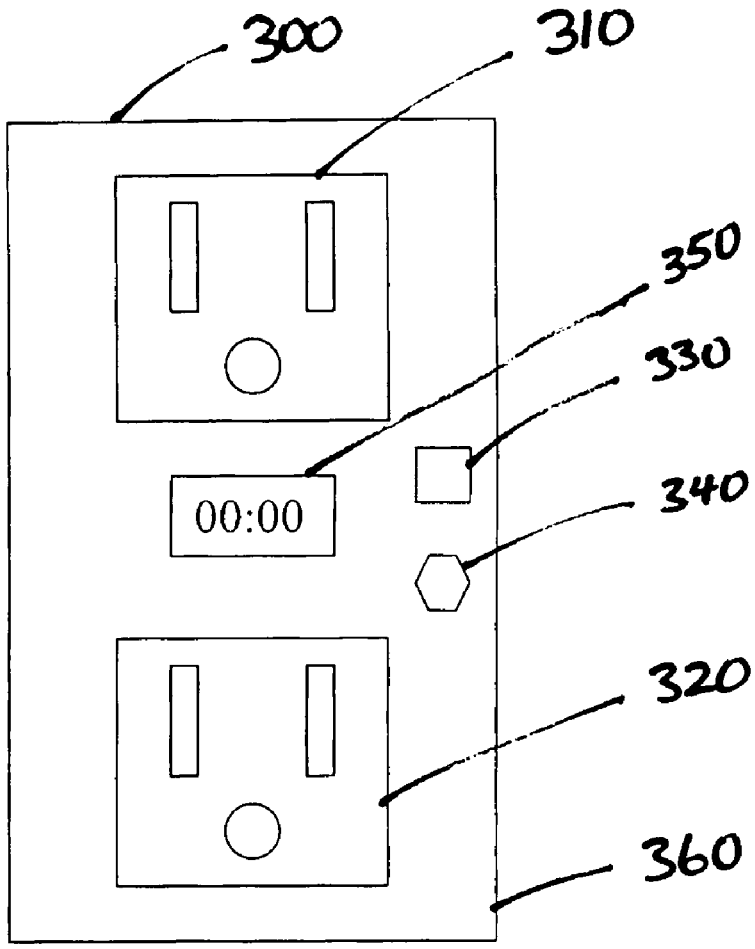
FIG. 3 illustrates a frontal view of an exemplary receptacle in a décor and duplex configuration, and having a Start-Button, Stop-Button, display device, and complementary faceplate.

FIG. 3 illustrates a front view an exemplary embodiment of the present invention, in which receptacle 300 is provided with a décor shape and a duplex (dual electrical sockets) configuration 310, 320. As illustrated, user interface can include Start-Button 330, Stop-Button 340, and display 350. As further illustrated, a complementary faceplate 360 can engage receptacle 300 so as to provide a more visually pleasing appearance. It should be noted that a single user interface can be associated with one or more sockets, in an independent or similar manner.

Figure 4:
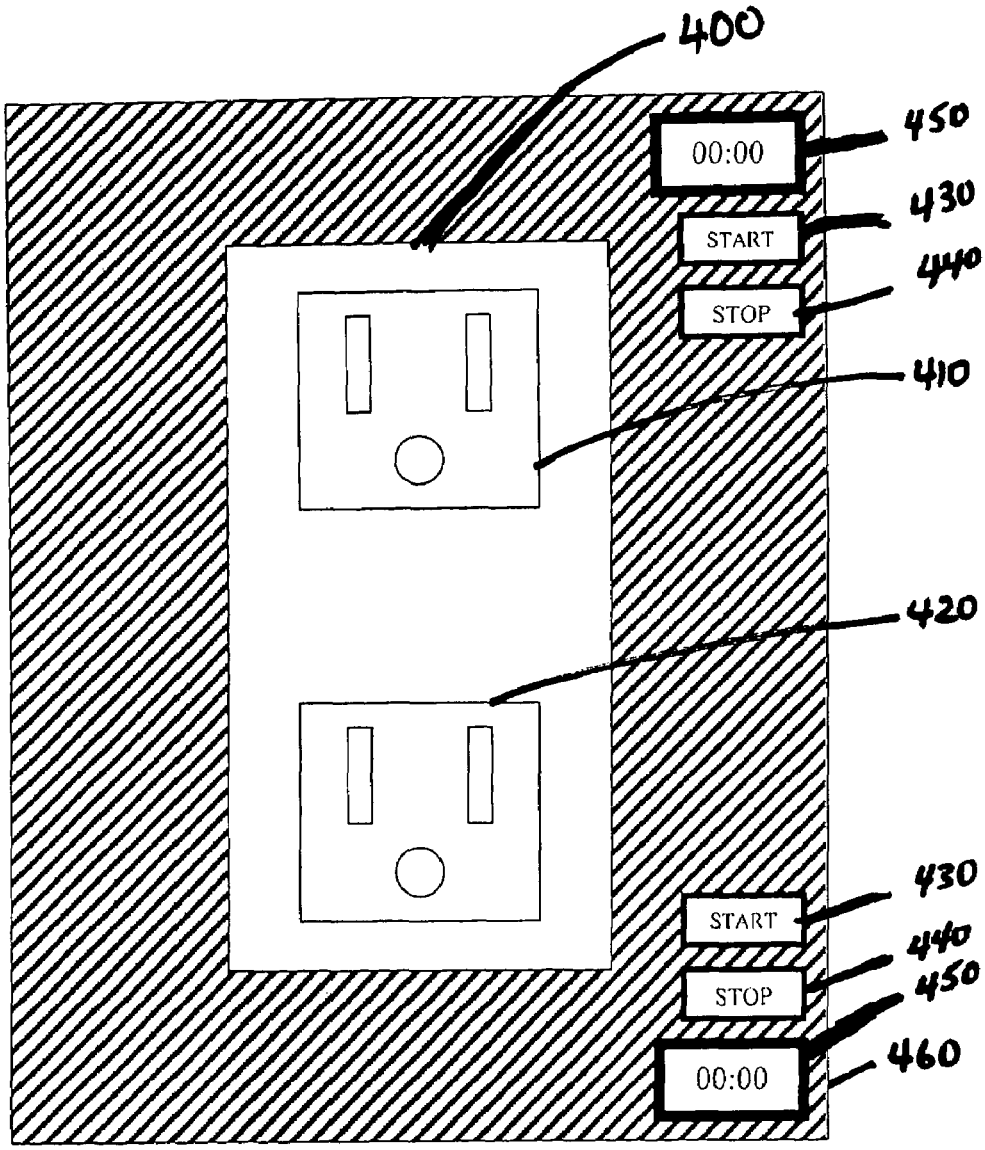
FIG. 4 illustrates a frontal view of another exemplary embodiment of the present invention, in which a user interface, in whole or in part, can be located on a faceplate.

FIG. 4 illustrates a front view of another exemplary embodiment of the present invention, in which receptacle 400 is also provided with a décor shape and a duplex configuration 410, 420. As illustrated, user interface, in whole or in part, can be located on faceplate 460, which can be desirable to allow easier user access whilst an electrical plug is engaged with electrical sockets 410, 420. Notably, respective user interfaces are provided for each of electrical sockets 410, 420; and therefore, each user interface can be communicatively connected to respective switches for each socket. Further, it should be noted that to the extent desired, a single user interface can be utilized to control a single or plurality of switches for a respective single or plurality of sockets, with the switches being controlled either independently or similarly by the single user interface. Also notably, according to the present invention, faceplate 460 need not conform in dimensions to that of a conventional faceplate, and therefore, may be larger or smaller, and/or be shaped differently (i.e., any shape other than rectangular).

Faceplate 460 can be a separate component attachable to receptacle 400, or an integral part of receptacle 400. In the former case, a receptacle of the present invention may optionally include a receptacle interface for at least one of electrical and communicative connection with the receptacle interface, with any portion of a user interface located on such a faceplate being appropriately connected to the faceplate interface. In the latter case, faceplate 460 can be formed or attached to receptacle 400 in a manner that is intended to be mostly permanent to the extent desired.

According to the present invention, a user interface includes an input device and an output device. Via an input device, a user can initiate an activation command (and optionally, a deactivation command) to be sent to the timer. Via an output device, a user can be notified of a particular state of the present invention by way of an activation signal.

An input device includes at least one button. Many functions, input modes, and data entry techniques can be readily implemented via a single button. For example, and not in limitation, ones may be based on the number (i.e., "double-pressing"), duration, sequence, and/or combination of button presses. For example, a user may press a button for a long period of time (e.g., 2 seconds) in order to put the timer into a particular "state" or "mode" such as an Always-On or Always-Off state. Additionally, a particular state of the timer can be an Enter-Start-Time or Enter-End-Time state. Therefore, it should be understood that numerous functions and data entry techniques can be effectuated via a single button. However, plural buttons can be utilized to provide a means for simplifying, or avoiding overly complex, operating logistics for a user. Further, additional functionality can be provided via inclusion of a switch (e.g., an n-way mode switch: timer, schedule, always-on/off modes and/or socket selection), a dial, etc., for example and not in limitation.

In one exemplary embodiment, the receptacle of the present invention is, by default, in an "off" state. In other words, by default, no current is passed to one or more electrical sockets via one or more switches. Via the user interface, the user can initiate a timed "on" state, with the state being for a predetermined amount of time. For example, a user can depress a "start" button one or more times to add increments of time, which can be fifteen ("15") minutes increments, for example and not in limitation. In such a case, the timer triggers the switch(es) to close for this amount of time and current is passed to the socket(s). When the amount of time lapses, the switch or switches return to their default state(s), "open" and current in no longer so passed to one or more sockets. Notably, a user may add to the predetermined amount of time during the timed "on" state by depressing the same or different button, thereby creating a new predetermined amount of time.

In another exemplary embodiment, a user may additionally have the option of placing the receptacle in an "always on" mode. For example, the user may depress a button (as noted above) for an extended period of time, such as, for example and not in limitation, for about two ("2") seconds, which places the timer in the "always on" mode. Likewise, a user may place the receptacle in an "always off" mode (or return the receptacle to its default off state), by depressing the same or a different button for an extended period of time. This toggling manner of interacting with the receptacle is an example of the plural functions a single button can provide.

In another exemplary embodiment of the present invention, a user can place the timer into a "schedule" mode, and correspondingly, the timer can further include a clock having a set time for reference. For example, the user may depress a button for an extended period of time, such as, for example and not in limitation, for about two ("2") seconds, which places the timer into the "schedule" mode. Thereafter, the user may depress the same or a different button to cycle through time digits (e.g., hours, minutes) until a desired time representing a start time is reached. In an exemplary aspect, a user may hold down a button to more quickly cycle through time digits. Likewise, the user may enter a stop time. Accordingly, the timer can thereby set to close the electrical switch upon the start time, and to close the electrical switch upon reaching the stop time. Notably, multiple modes can be available in a single embodiment of the present invention. For example, an extended depressing of a button can cycle through available modes, with an output device indicating the active mode.

An activation command can take one or more forms depending on the particular mode and functionality desired, and effectively, triggers the timer to cause the current switch to close. A deactivation command can also take one or more forms, and effectively causes the current switch to open.

An output device can include a display device, such as an Light Emitting Diode ("LED") or Liquid Crystal Display screen, for example and not in limitation.

In one exemplary embodiment, a display device displays a numeric value, which can be a digit or a unit (e.g., a lighted bar or bars represent time). Additionally, a display device can provide a visual indication of a particular mode or state the receptacle is in. For example and not in limitation, a display device can display an indicator associated with a particular mode, such as always-on, awaiting input, error, etc.

In another exemplary embodiment, a display device can alternatively or additionally include a light, such as an LED. For example, an LED can be a single or dual colored light or lights, such as "green" and "red" colored, and/or glow in various blinking manners and/or glow in a steady manner.

In another exemplary embodiment, a display device can optionally be back-lighted. For example, back-lighting can render the display device more easily readable. Also, back-lighting can be activated when a socket is powered, and therefore, such activating can serve as a visual indication to the user that the socket is energized.

An activation signal informs a user whether a socket is activated, or in other words, whether electrical current is being passed to a socket, and can include, for example and not in limitation, an amount of time remaining or a powered LED light. In an exemplary embodiment of the present invention, such a signal may be an amount of time shown via a display device, and/or a powered LED glowing "red" to indicate that the current switch is closed or glowing "green" to indicate that the current switch is open, for example and not in limitation. Alternatively or additionally, an audible signal may be provided to the extent desired, and accordingly, a speaker and sound generator can be provided.

Power for the present invention can be provided via a battery and/or the electrical current provided from the electrical wires. Notably, a receptacle of the present invention can optionally include a reset mechanism that resets the receptacle during a power outage. Further, optionally, a battery backup can be provided to preserve data stored in any volatile memory, such as a clock, for example and not in limitation.

It will be apparent to one skilled in the art that the manner of making and using the claimed invention has been adequately disclosed in the above-written description of the exemplary embodiments and aspects taken together with the drawings.

It should be understood, however, that the invention is not necessarily limited to the specific embodiments, aspects, arrangement, and components shown and described above, but may be susceptible to numerous variations within the scope of the invention. Accordingly, the specification and drawings are to be regarded in an illustrative and enabling, rather than a restrictive, sense.

Therefore, it will be understood that the above description of the embodiments of the present invention are susceptible to various modifications, changes, and adaptations, and the same are intended to be comprehended within the meaning and range of equivalents of the appended claims.

I claim:

1. An electrical receptacle adapted to mount substantially within an electrical box, said receptacle comprising:

a current switch having a default open state, and a closed state;

an electrical socket adapted to receive an electrical plug, said electrical socket being conductively connected to said current switch;

an electrical interface adapted to directly couple to wires conductively carrying electrical current, and further adapted to conductively carry the electrical current to said current switch; and a user interface, communicatively connected to a timer, and having an input device adapted to receive an activation command from a user, and an output device adapted to send an activation signal to the user;

wherein when said current switch is in the closed state, the electrical current conductively reaches said electrical socket, when said current switch is in the open state, the electrical current does not conductively reach said electrical socket, and the timer, upon receipt by the input device of the activation command, causes said current switch to close for a predetermined amount of time and causes the output device to send the activation signal.

2. The receptacle of claim 1, wherein the electrical box is disposed within one of a wall and a floor.

3. The electrical receptacle of claim 2, wherein said receptacle includes a faceplate having an interior face plate surface and an exterior face plate surface, the one of a wall and a floor respectively includes one of an exterior wall surface and an exterior floor surface, at least a portion of at least one of the input device and the output device is accessible by the user from the exterior faceplate surface, and when said receptacle is attached to the electrical box, the interior face plate surface opposes the one of an exterior wall surface and an exterior floor surface.

4. The receptacle of claim 3, wherein the receptacle includes a receptacle interface connected to said timer, the faceplate is removably attachable to said receptacle, the faceplate includes a faceplate interface for at least one of electrical and communicative connection with the receptacle interface, and the at least a portion of at least one of the input device and the output device is connected to the faceplate interface.

5. The receptacle of claim 3, wherein the faceplate is integral with the receptacle.

6. The receptacle of claim 1, wherein the predetermined amount of time is an indefinite amount of time.

7. The receptacle of claim 6, wherein the input device is further adapted to receive a deactivation command from the user, the output device is further adapted to send a deactivation signal to the user, and upon receipt by the input device of the deactivation command, the timer causes said switch to open and the output device to send the deactivation signal.

8. The receptacle of claim 1, wherein the input device includes at least one button.

9. The receptacle of claim 1, wherein the output device includes a display device.

10. The receptacle of claim 9, wherein the display device displays a numeric value.

11. The receptacle of claim 1, wherein said input device is further adapted to receive a start time and an end time from the user, the timer includes a clock having a set time, and based on the set time, the timer causes said current switch to close when the start time is reached and to open when the end time is reached.

* * * * *